US006360759B1

(12) United States Patent
Lin et al.

(10) Patent No.: US 6,360,759 B1
(45) Date of Patent: Mar. 26, 2002

(54) MULTIPLE-FOLD AUTOMATIC UMBRELLA WITH PENTA-FOLD ROPE

(75) Inventors: Chung-Kuang Lin; Jung-Jen Chang, both of Taipei Hsien (TW)

(73) Assignee: Fu Tai Umbrella Works Ltd., Taipei Hsien (TW)

( * ) Notice: Subject to any disclaimer, the term of this patent is extended or adjusted under 35 U.S.C. 154(b) by 0 days.

(21) Appl. No.: 09/585,334

(22) Filed: Jun. 2, 2000

(51) Int. Cl.[7] ..... A45B 25/14

(52) U.S. Cl. ..... 135/24; 135/25.1; 135/25.3; 135/28; 135/40

(58) Field of Search ..... 135/22, 24, 23, 135/25.1, 25.3, 25.4, 40, 41

(56) References Cited

U.S. PATENT DOCUMENTS 4,986,294 A * 1/1991 Wu ..... 135/22
5,267,583 A * 12/1993 Wu ..... 135/24
5,617,889 A * 4/1997 Wu ..... 135/22
5,626,161 A * 5/1997 Lin et al. ..... 135/24
5,791,359 A * 8/1998 Lin et al. ..... 135/24
5,803,102 A * 9/1998 Ko ..... 135/24
5,868,151 A * 2/1999 Kuo ..... 135/24
6,145,522 A * 11/2000 Ko ..... 135/24
6,170,498 B1 * 1/2001 Wu ..... 135/24
6,173,722 B1 * 1/2001 Ko ..... 135/24

* cited by examiner

*Primary Examiner*—Carl D. Friedman
*Assistant Examiner*—Winnie Yip
(74) *Attorney, Agent, or Firm*—Troxell Law Office PLLC

(57) ABSTRACT

A multiple-fold automatic umbrella includes a penta-fold rope having its inner rope end secured with a locking head locked in a grip of a central shaft and defining a first rope section of the penta-fold rope from the locking head through an interior of the shaft to an upper guiding roller rotatably mounted in an upper portion of the shaft; a second rope section of the penta-fold rope from the upper guiding roller to a first lower guiding roller rotatably mounted on a lower runner slidably held in the shaft; a third rope section of the rope from the first lower guiding roller towards at least an uppermost guiding roller rotatably mounted in a top portion of the shaft; a fourth rope section from the uppermost guiding roller towards a second lower guiding roller rotatably mounted on the lower runner opposite to the first guiding roller; and a fifth rope section from the second lower guiding roller towards an outer rope end secured to an upper notch formed on the top of the shaft, thereby providing a rope dynamically balanced on opposite sides of the shaft for enhancing a smooth opening and closing operation of the umbrella.

3 Claims, 8 Drawing Sheets

MULTIPLE-FOLD AUTOMATIC UMBRELLA WITH PENTA-FOLD ROPE

BACKGROUND OF THE INVENTION

U.S. Patent application entitled "Automatic Penta-fold Umbrella" filed by the same inventors of this application on Dec. 15, 1998 with a Ser. No. of: 09/215,635 disclosed an automatic umbrella having penta-fold central shaft (1) consisting of five tubes (11, 13, 13*a*, 13*b*, 14) and penta-fold rib assembly (2) for obtaining a shortened length of the shaft (1) when folded.

However, it still has a large diameter for the folded tubes of the shaft (1) when closing and folding the umbrella of the prior application due to the total thickness summed up by the five tubes (11, 13, 13*a*, 13*b*, 14) of the shaft (1). It is therefore difficult to make a "slim" umbrella after being folded.

The present inventors have found that a penta-fold rope mechanism may be provided for forming a slim automatic umbrella having quadruple-fold central shaft in accordance with the present invention.

SUMMARY OF THE INVENTION

The object of the present invention is to provide a multiple-fold automatic umbrella including a penta-fold rope having its inner rope end secured with a locking head locked in a grip of a central shaft and defining a first rope section of the penta-fold rope from the locking head through an interior of the shaft to an upper guiding roller rotatably mounted in an upper portion of the shaft; a second rope section of the penta-fold rope from the upper guiding roller to a first lower guiding roller rotatably mounted on a lower runner slidably held in the shaft; a third rope section of the rope from the first lower guiding roller towards at least an uppermost guiding roller rotatably mounted in a top portion of the shaft; a fourth rope section from the uppermost guiding roller towards a second lower guiding roller rotatably mounted on the lower runner opposite to the first guiding roller; and a fifth rope section from the second lower guiding roller towards an outer rope end secured to an upper notch formed on the top of the shaft, thereby providing a rope dynamically balanced on opposite sides of the shaft for enhancing a smooth opening and closing operation of the umbrella.

DETAILED DESCRIPTION

Figure 1:
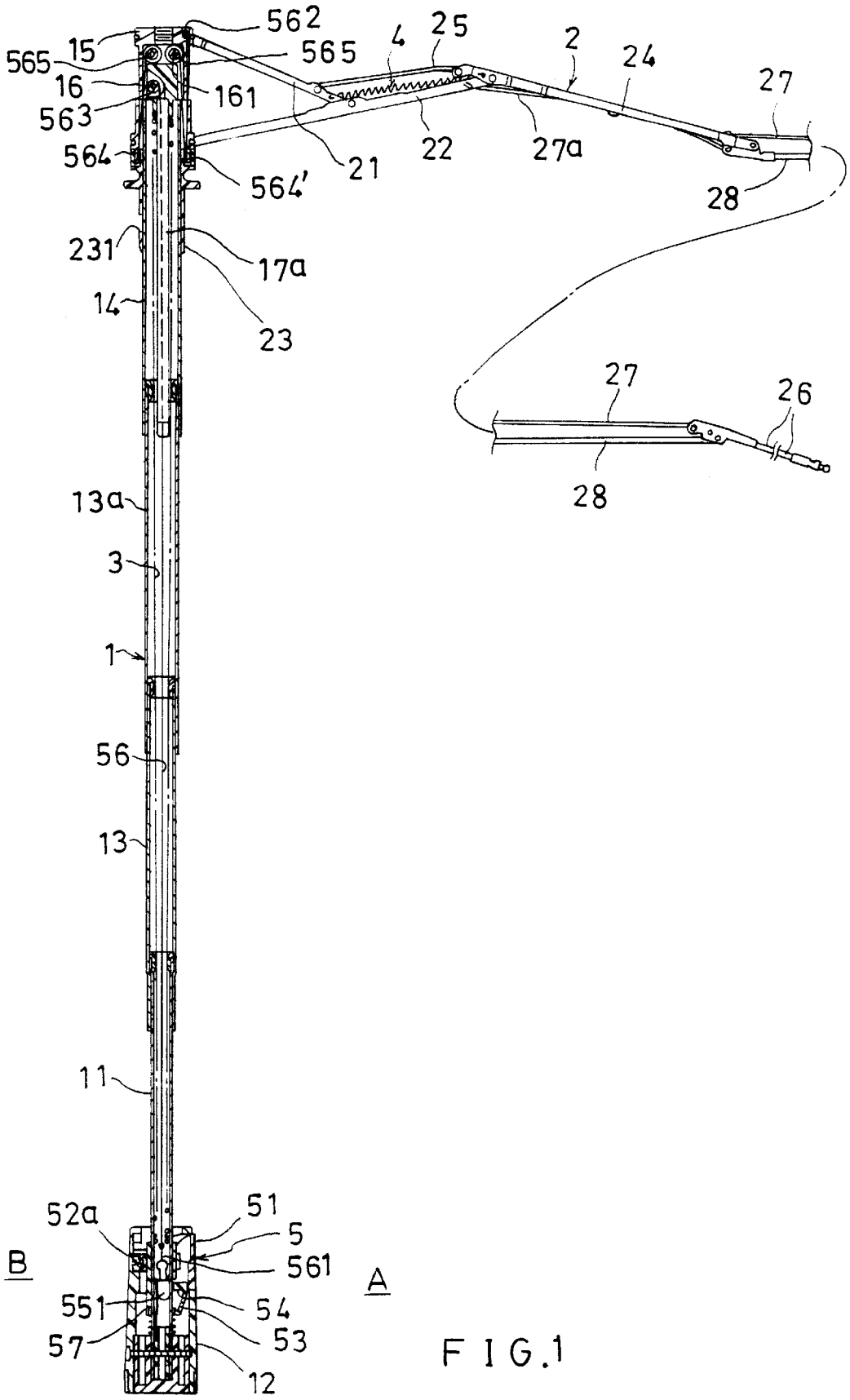
FIG. 1 is an illustration showing an open umbrella of the present invention.
Figure 2:
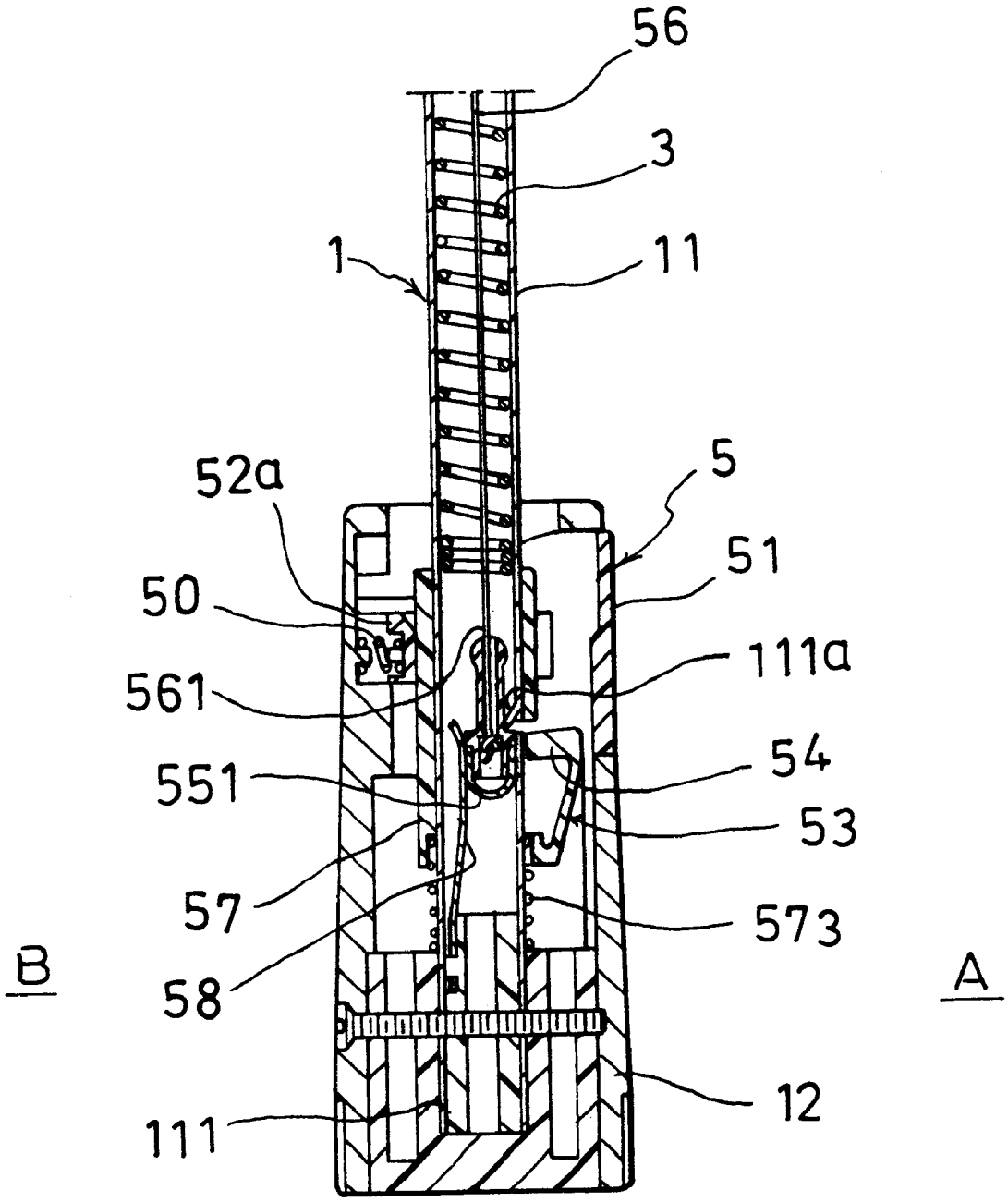
FIG. 2 is a partial enlarged view of the umbrella from FIG. 1.
Figure 3:
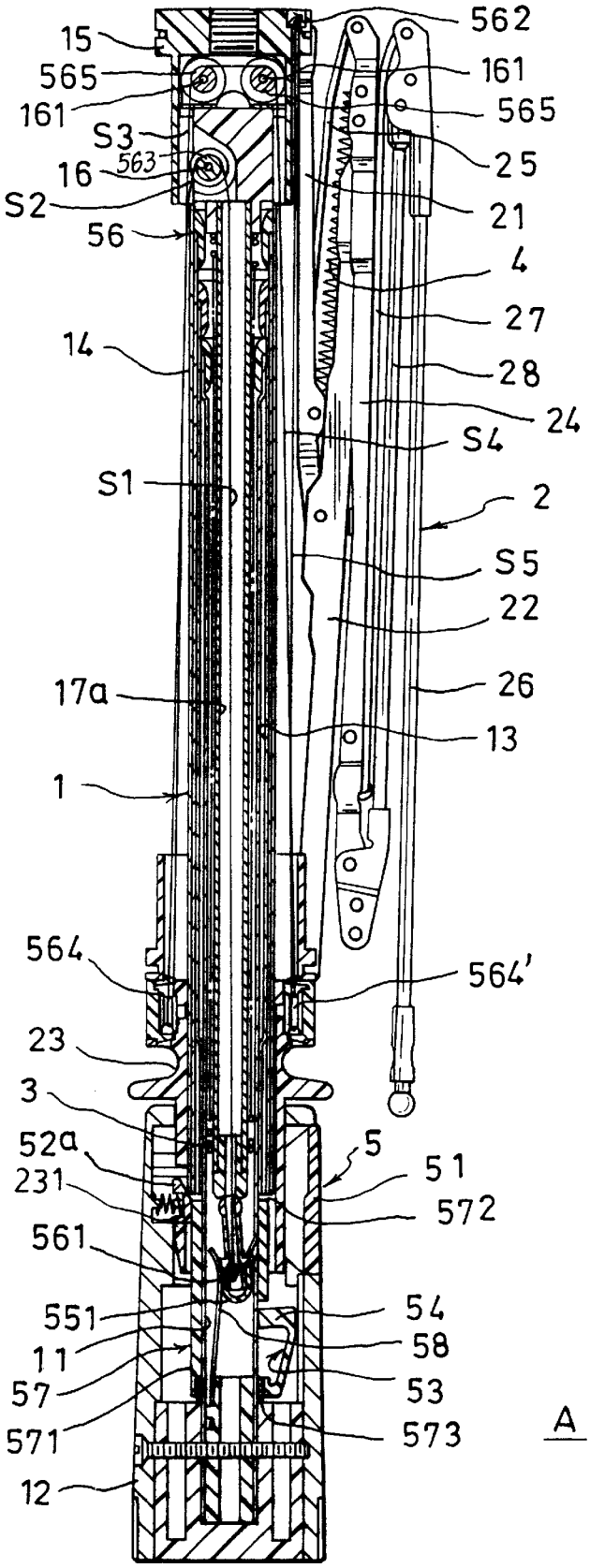
FIG. 3 shows the umbrella as folded from FIG. 1.

As shown in FIGS. 1~3, a preferred embodiment of the multiple-fold automatic umbrella of the present invention comprises: a central shaft 1, a rib assembly 2, an opening spring 3 retained in the central shaft 1, a plurality of closing springs 4 respectively held in the rib assembly 2, and a control means 5.

The central shaft 1 includes: a lower tube 11, a grip 12 secured to a lower portion 111 of the lower tube 11, a first middle tube 13 telescopically engageable with the lower tube 11, a second middle tube 13*a* telescopically engageable with the first middle tube 13, an upper tube 14 telescopically engageable with the second middle tube 13*a*, an upper notch 15 formed on a top end of the shaft 1, and a central sleeve 17*a* secured to an inner block 151 formed in a top portion of the shaft 1, thereby forming a quadruple-fold central shaft 1 consisting of four tubes 11, 13, 13*a* and 14.

The rib assembly 2 includes: a top rib 21 pivotally secured to the upper notch 15, a stretcher rib 22 pivotally secured to the top rib 21 and a lower runner 23 slidably held on the shaft 1, an intermediate rib 24 pivotally secured to the stretcher rib 22 and also pivotally secured to the top rib 21 by means of an inner connecting rib 25, a tail rib 26 pivotally secured to the intermediate rib 24 respectively through an outer connecting rib 28 and an outer spring rib 27, and an inner spring rib 27*a* pivotally secured between the stretcher rib 22 and the outer connecting rib 28, thereby forming a quadruple-fold rib assembly.

The control means 5 includes: a push button 51 resiliently held in a button hole formed in the grip 12; an upper latch 52*a* integrally formed on an inner ring portion of the push button 51, a tensioning spring coil 50 resiliently urging the upper latch 52*a* towards a center of the shaft 1 for engaging the upper latch 52*a* with a slot 231 formed in the lower runner 23 when closing the umbrella, whereby upon depression of the push button to disengage the upper latch 52*a* from the runner 23, the umbrella will be opened; a closing controller 53 including a lower latch 54 resiliently formed on an anti-false operation safety means 57 having an elongate cylinder 571 slidably held in the lower portion 111 of the lower tube 11; with the elongate cylinder 571 having an upper rim 572 of the cylinder 571 operatively depressed downwardly as urged by the middle tubes 13, 13*a* when closing the umbrella and folding the tubes of the central shaft 1 to thereby lower the lower latch 54 without being falsely actuated during the opening operation when depressing the button 51 for opening the umbrella for preventing a false closing operation; with the cylinder 571 normally resiliently urged upwardly by a restoring spring 573 retained in the grip 12 to raise the lower latch 54 to face and approximate a locking head 551 secured with a penta-fold rope 56 of the present invention, whereby upon a depression of the push button to disengage the locking head 551 from a protrusion 111*a* formed in the lower tube 11, the umbrella will be closed from its opening state as shown in FIG. 1.

The penta-fold rope 56 includes: an inner (or lower) rope end 561 secured to the locking head 551 which is engaged with the protrusion 111*a* formed on the lower tube 11 when closing and folding the umbrella (FIG. 3) as downwardly urged by the inner sleeve 17*a*; a first rope section S1 directed from the inner rope end 561 secured on the locking head 551 when closing the umbrella towards (and to be wound on) an upper guiding roller 563 rotatably mounted by an upper pivot 16 on the inner block 151 formed in an upper portion of the shaft 1; a second rope section S2 directed from the upper guiding roller 563 along one side of the upper tube 14 of the shaft 1 towards (and to be wound on) a first lower guiding roller 564 rotatably mounted on the lower runner 23; a third rope section S3 directed from the first lower guiding roller 564 towards (and to be wound on) an uppermost guiding roller means (or an uppermost guiding means) 565 rotatably mounted in (or formed in) a top portion of the shaft 1; a fourth rope section S4 directed from the uppermost guiding roller means 565 along the other side of the upper tube 14 towards (and to be wound on) a second lower guiding roller 564' rotatably mounted on the lower runner 23 opposite to the first lower guiding roller 564; and a fifth rope section S5 directed from the second lower guiding roller 564' towards an outer (or upper) rope end 562 fixed on the upper notch 15.

The uppermost guiding roller means 565 may be a pair of uppermost guiding rollers 565 respectively rotatably mounted on the top position of the shaft 1 disposed on opposite sides of a longitudinal center of the shaft 1 by a pair of uppermost pivots 161.

The uppermost guiding rollers 565 may be modified to be an arcuate guiding groove arcuately formed in the top portion of the shaft 1 to wind the rope 56 thereon. Therefore, the arcuate guiding groove will become an alternative design choice of the uppermost guiding (roller) means.

The penta-fold rope 56 is continuously directed from an interior in the shaft to be disposed on opposite sides of the shaft 1 to be dynamically balanced on the two sides of the shaft 1 to well distribute the stress at the center and on opposite sides of the shaft 1, thereby providing a well balanced stroke of the rope for smoothly pulling the rope 56 during the umbrella opening and closing operations.

The uppermost guiding roller 565 is positioned above the upper guiding roller 563 as shown in the drawing figures. However, the uppermost guiding roller 565 may also be modified to other suitable locations on the upper or top portion of the shaft 1 in order to well accommodate the rope for the two lower guiding rollers 564, 564' and the other rollers.

The uppermost guiding roller means may also be an uppermost guiding roller having a large diameter (not shown) generally equal to a diameter of the upper tube 14 of the central shaft 1.

As shown in FIGS. 1~3, even the rope 56 is a penta-fold rope including five rope sections S1~S5, the rope 56 may still be adapted for quadruple-fold shaft 1 and quadruple-fold rib assembly 2. Naturally, the number of folds of the umbrella shaft and rib assembly are not limited for the uses of the penta-fold rope in accordance with the present invention.

Another preferred embodiment of the present invention is shown in FIGS. 4~9 having the same umbrella structure and the same penta-fold rope 56 as aforementioned adapted for use as quadruple-fold shaft 1 and rib assembly 2, but having modifications for some elements as hereinafter described.

The inner sleeve 17*a* has been eliminated and substituted with a slim fine solid guiding rod 17*b* having a small diameter greatly smaller than the diameter of the inner sleeve 17*a*.

The guiding rod 17*b* has its upper end fixed in the inner block 151 formed on an upper portion of the shaft 1 and having a guiding collar 17*c* formed on a bottom end of he guiding rod 17*b* for passing or sliding the rope 56 through the guiding collar 17*c*, whereby upon closing of the umbrella from FIG. 4 to FIG. 8, the guiding collar 17*c* and the guiding rod 17*b* will push the locking head 551 downwardly in order to be engaged with an engaging hole 111*b* formed in a bottom sleeve 11*a* in the grip 12.

The upper latch 52*a* and the coil spring 50 have also been modified to be a "slim" structure by replacing the coil spring 50 with an elongate spring plate 50*a* having a longer length with a larger force of arm (thereby shortening the spring stroke and making the grip slimmer) for urging an upper latch 52 towards a front side A of the grip 12.

Figure 8:
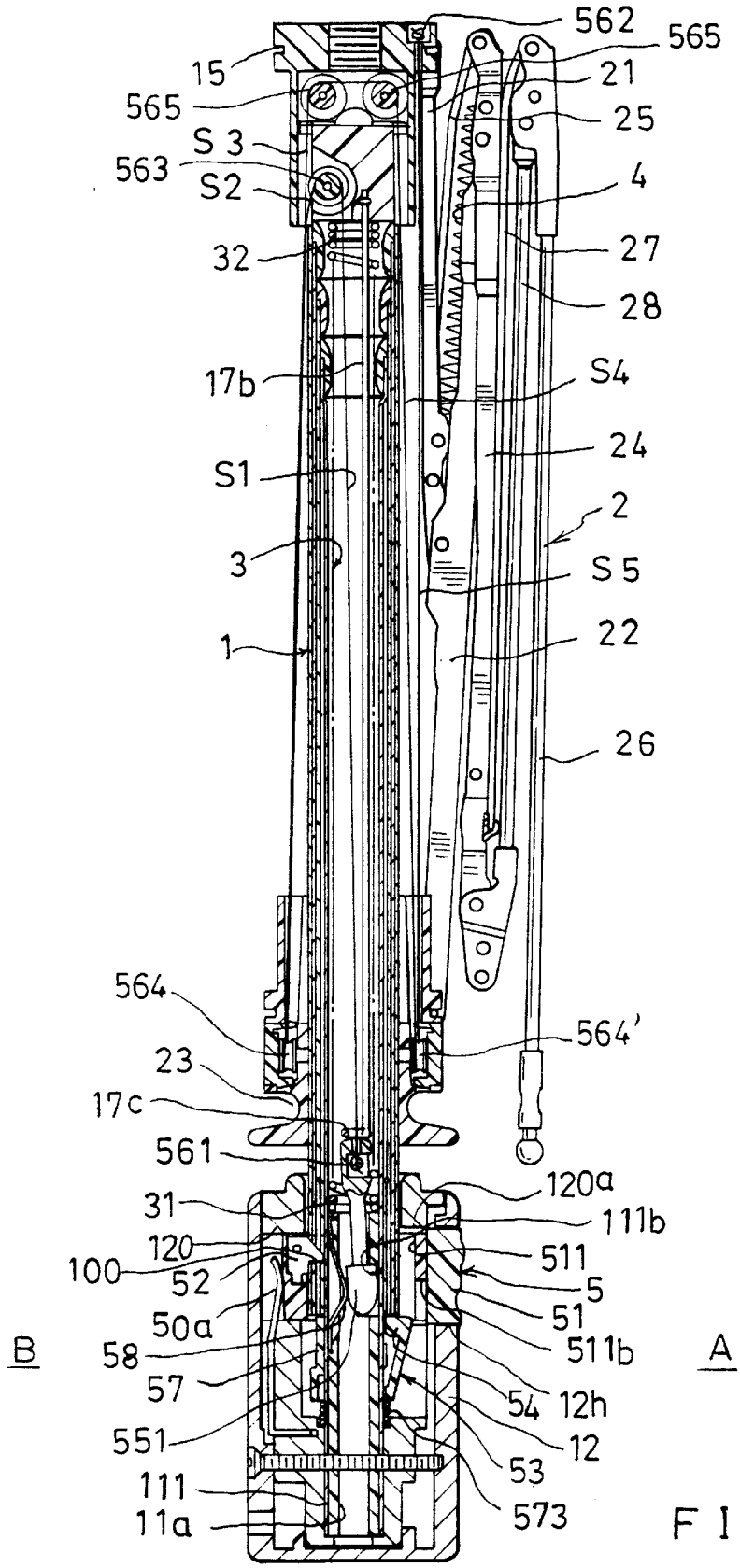
FIG. 8 shows a folded umbrella when closed from FIG. 4.
Figure 9:
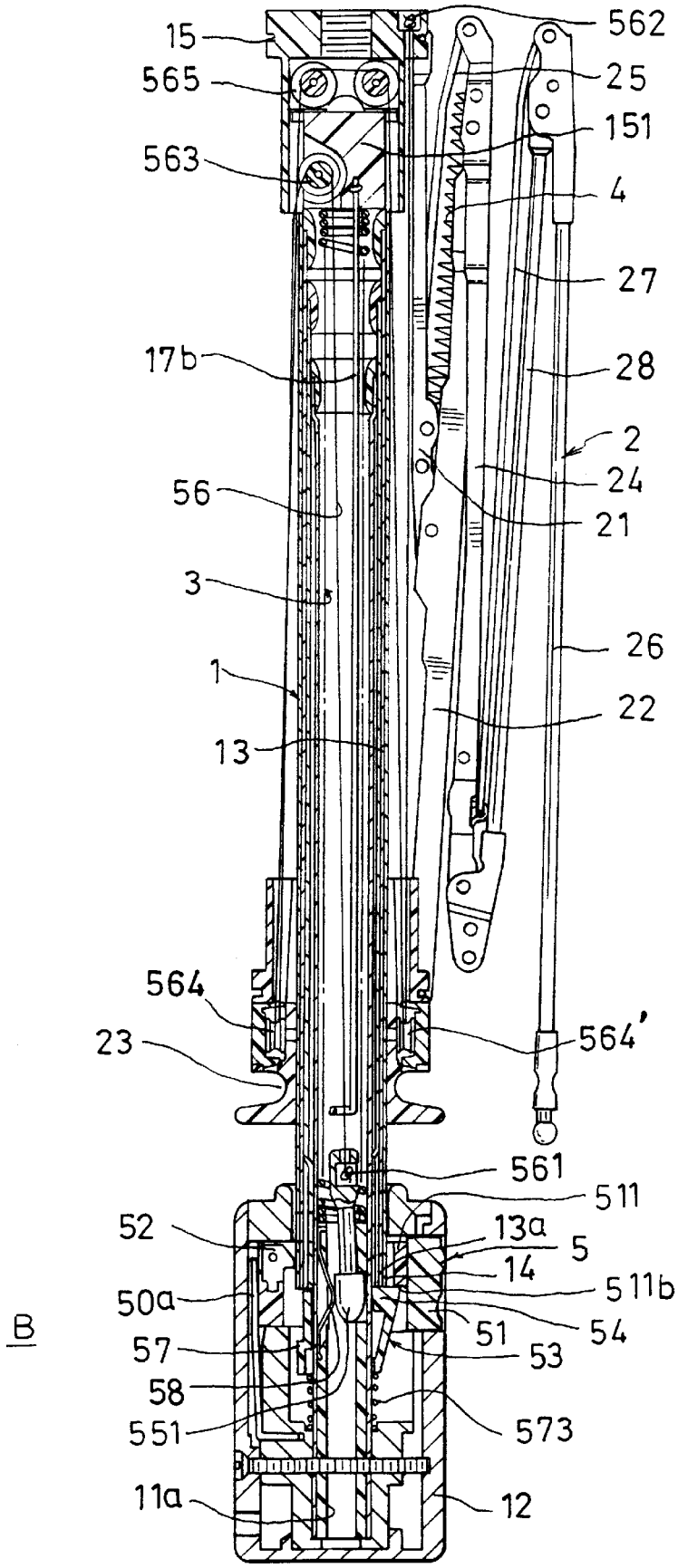
FIG. 9 shows the anti-false operation safety means of the present invention upon depression of the push button in order for opening the umbrella from FIG. 8.

The control means 5 includes: a push button 51 slidably held in a button hole 12*b* adjacent to a front side A of the grip 12 and having a protrusion portion 51*u* on the button 51 showing an opening mark for opening the umbrella and a recess portion 51*d* in the button 51 showing a closing mark for closing the umbrella; an upper latch 52 having a sloping latch portion 522 and made of metal including steel and other strong materials formed on a rear portion of a sliding ring member 511 slidably held in a sliding groove 120*a* formed in a bottom plug 120 fixed in the grip 12; an elongate spring plate 50*a* having a base portion 501 secured in the bottom plug 120 adjacent to a rear side B of the grip 12, and a convex portion 502 formed on an upper portion of the spring plate 50*a* for resiliently urging the sliding ring member 511 and the push button 51 forwardly ready for a depression of the push button 51, with the elongate spring plate 50*a* resiliently urging the upper latch 52 for engaging an engaging hole 100 formed in the middle tube 13*a*, 13 and in the upper tube 14 for "locking" the tubes of the shaft 1 when lowered through a central ring hole 511*a* formed in the ring member 511 for closing the umbrella as shown in FIG. 8; a closing controller 53 having a lower latch 54 resiliently secured to an elongate cylinder 571 of an anti-false operation safety means 57 resiliently slidably held in the bottom plug 120 as upwardly urged by a tension spring 573, whereby upon inward depression on the push button 51 when opening the umbrella from FIGS. 8, 9 to FIG. 1 to push the ring member 511 rearwardly to disengage the upper catch 52 from the engaging hole 100 formed in the tubes 14, 13*a*, 13 and to allow a latch slot 511*b* formed in a front bottom portion of the ring member 511 to be engaged with the lower latch 54, an upward rising of the lower latch 54 will be retarded by the ring member 511 (FIG. 9) to prevent a false operation as accidentally depressing the lower latch 54 during the operation for opening the umbrella; and a penta-fold rope 56 having five rope sections S1~S5 as aforementioned secured between a locking head 551 and an upper notch when the locking head 551 is locked in the grip 12 when closing the umbrella (FIG. 8). The detailed description for the penta-fold rope 56 is omitted accordingly.

The bottom plug 120 includes: a central hole 120*b* for a sliding movement of the elongate cylinder 571 within the central hole 120*b* and allowing a downward movement of the tubes of the shaft 1 to depress the elongate cylinder 571 downwardly and to engage the locking head 551 with an engaging hole 111*b* formed in a bottom sleeve 11*a* jacketed in the lower tube 11 secured in a bottom portion 120*c* of the plug 120 when closing the umbrella; with a spring plate 58 secured on the bottom sleeve 11*a* for resiliently guiding the locking head 551 to be engaged with the engaging hole 111*b* in the bottom sleeve when closing the umbrella. The bottom sleeve 11*a* has a top rim provided for retaining the opening spring 3.

The upper latch 52 is secured to the ring member 511 by a pin 521, or the upper latch 52 may be integrally formed with the ring member.

Figure 4:
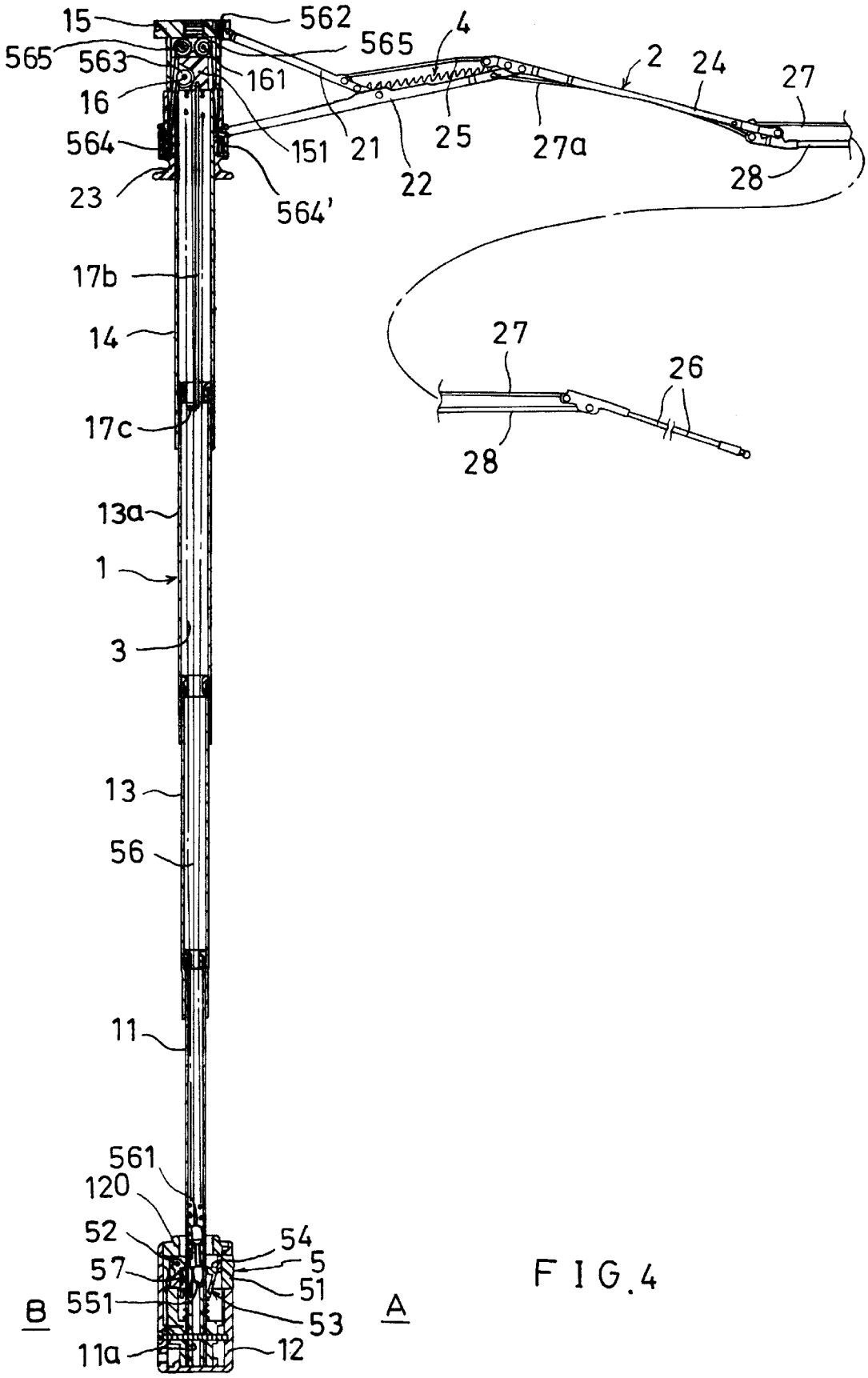
FIG. 4 shows another preferred embodiment of the present invention when opened.
Figure 5:
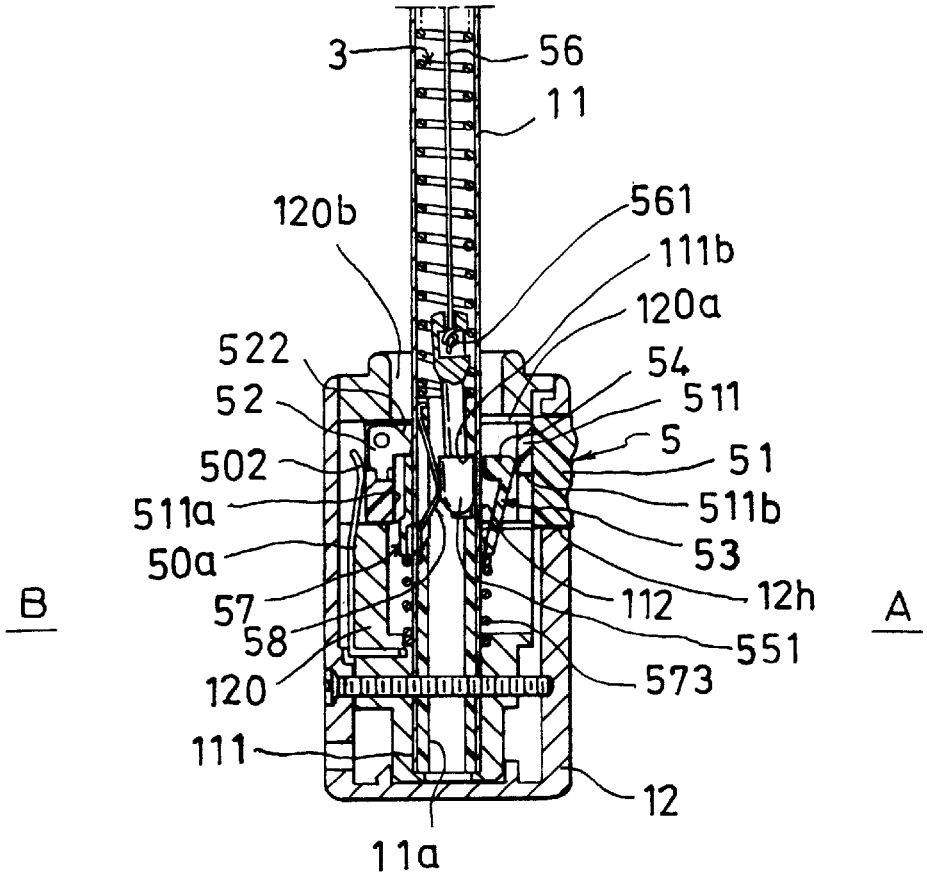
FIG. 5 is a partial enlarged view of the umbrella from FIG. 4.

For closing the umbrella from FIGS. 4, 5, the push button 51 is depressed to inwardly thrust the ring member 511 and the lower latch 54 through a hole 112 in the tube 11 to disengage the locking head 551 from the engaging hole 111*b* to release the tension force on the rope 56, the closing springs 4 will restore to retract the rib assembly 2 for closing the umbrella. For opening the umbrella from FIG. 8 to FIG.

4, the push button 51 is depressed to disengage the upper latch 52 from the engaging hole 100 in the tubes, the opening spring 3 will extend the tubes of the shaft 1 and the rib assembly 2 for opening the umbrella.

Figure 6:
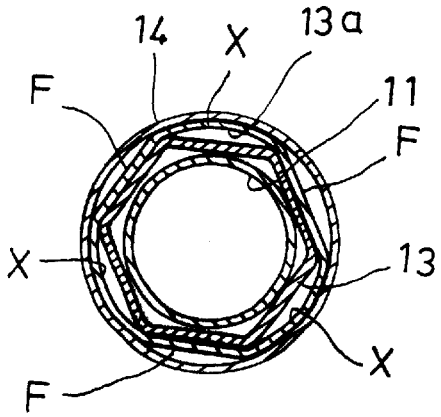
FIG. 6 is a cross sectional drawing of the tubes of the central shaft of the present invention when folded.
Figure 7:
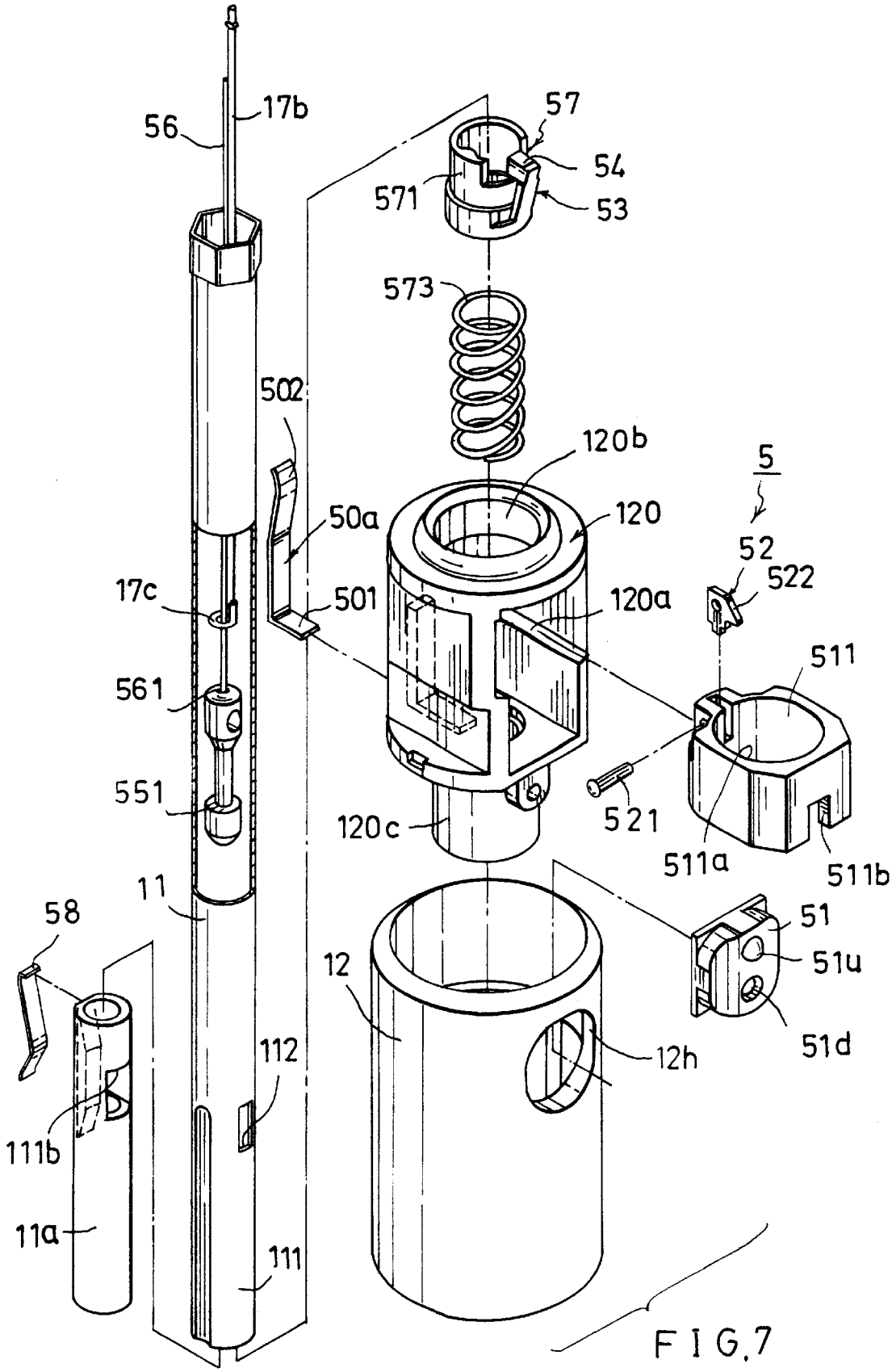
FIG. 7 is an exploded view of the present invention of FIG. 4.

The central shaft 1 when folded as shown in FIG. 6 includes: a lower tube 11 having a cross section of circular shape; a first middle tube 13 having a cross section of hexagonal shape; a second middle tube 13*a* having a cross section of partially flattened circular shape having three convex portions X and three flat portions F around the periphery of the second middle tube 13*a*, and an upper tube 14 having a cross section of circular shape.

The present invention, especially as shown in FIGS. 4~9, has the following advantages superior to the prior arts:

1. The penta-fold rope 56 is continuously directed from the interior in the shaft 1 through the plural rollers to be finally secured to the upper notch, disposing the rope on opposite sides of the shaft 1 for a dynamic balancing for the rope stroke for enhancing a smooth operation for opening and closing the umbrella.
2. The guiding rod 17*b* is fine in volume and light in weight, helpful for making a slim shaft for a compact umbrella.
3. The elongate spring plate 50*a* with a shorter stroke for urging the upper catch 52 has substituted the coil spring having a longer spring stroke when compressed or restored, thereby being helpful for making a slim grip and slim umbrella.
4. When closing the umbrella, the locking head 551 is engaged with a hole 111*b* directly cut out in the bottom sleeve 11*a* (without forming an inwardly extended protrusion 111*a*), thereby making a slim grip and slim umbrella.

The present invention may be modified without departing from the spirit and scope of the present invention.

We claim:

1. A multiple-fold automatic umbrella comprising:

a central shaft consisting a plurality of tubes telescopically engageable one another for making multiple folds of the central shaft;

a rib assembly including at least a top rib pivotally secured to an upper notch formed on a top of said central shaft, a stretcher rib pivotally secured to said top rib and pivotally secured to a lower runner slidably held in said central shaft, and a plurality of ribs pivotally secured with one another and pivotally connectable to said top rib and said stretcher rib;

an opening spring retained in said central shaft for opening the umbrella;

a plurality of closing springs retained on said rib assembly for closing the umbrella; and a control means including a push button resiliently slidably held in a grip formed on a lower portion of said shaft, an upper latch resiliently held in said grip for engaging said shaft and said runner when folded when closing the umbrella and operatively disengaged from said shaft and said runner upon depression of said push button for opening the umbrella, a closing controller having a lower latch resiliently held in said grip and operatively disengaging a locking head for closing the umbrella; said locking head connected with a penta-fold rope having an inner rope end secured to said locking head when closing the umbrella and an outer rope end secured to said upper notch;

said penta-fold rope defining a first rope section directed from said inner rope end, and then directed from a guiding collar formed on a bottom portion of a guiding rod having a fine diameter and secured to an upper portion in said shaft, towards and to be wound on an upper guiding roller rotatably mounted on an upper portion of said shaft; a second rope section directed from said upper guiding roller towards and to be wound on a first lower guiding roller rotatably mounted on said lower runner slidably held on said shaft along one side of said shaft; a third rope section directed from said first lower guiding roller towards and to be wound on an uppermost guiding means formed in a top portion in said shaft; a fourth rope section directed from said uppermost guiding means towards and to be wound on a second lower guiding roller rotatably mounted on said runner opposite to said first lower guiding roller along the other side of said shaft; and a fifth rope section directed from said second lower guiding roller towards the outer rope end to be fixed on said upper notch, thereby dynamically balancing said rope on opposite sides of said shaft for enhancing a smooth opening and closing operation of the umbrella.

2. A multiple-fold automatic umbrella according to claim 1, wherein said control means includes an elongate spring plate having a base portion secured to a bottom plug fixed in said grip, and a convex portion formed on an upper portion of said elongate spring plate for resiliently urging said upper latch and said push button forwardly; and said upper latch integrally formed with a sliding ring member slidably held in said grip and operatively depressed by said push button.

3. A multiple-fold automatic umbrella according to claim 1, wherein said push button includes a protrusion portion served as an opening mark on said button, and a recess portion served as a closing mark on said button.

* * * * *